US005765749A

United States Patent [19]

Harper

[11] Patent Number: 5,765,749

[45] Date of Patent: Jun. 16, 1998

[54] MAILBOX INSERT DEVICE

[75] Inventor: Karl Harper, Clarksville, Tenn.

[73] Assignee: American Way Products, Inc., Elkton, Ky.

[21] Appl. No.: 681,616

[22] Filed: Jul. 29, 1996

[51] Int. Cl.[6] ..... B65D 91/00

[52] U.S. Cl. ..... 232/17

[58] Field of Search ..... 232/17, 1 R, 28, 232/29, 27, 30, 38

[56] References Cited

U.S. PATENT DOCUMENTS

| | | | |
|---|---|---|---|
| 838,194 | 12/1906 | Larsh | 232/17 |
| 4,600,143 | 7/1986 | Harlow et al. | 232/17 |
| 4,714,192 | 12/1987 | Harlow et al. | 232/17 |
| 5,009,366 | 4/1991 | Van Druff et al. | 232/17 |
| 5,083,703 | 1/1992 | Blyakharov | 232/17 |

*Primary Examiner*—Jerry Redman

*Attorney, Agent, or Firm*—Dressler, Rockey, Milnamow & Katz, Ltd.

[57] ABSTRACT

A mailbox insert structure positionable within a mailbox for aiding in the removal of mail from the mailbox, having a floor portion, a back wall portion, a pair of opposite side wall portions, generally open front and top portions, a finger engagement portion positioned near the front of the floor portion and which is engagable for pulling the insert structure outwardly through the mailbox door opening so that mail can be removed from the insert structure through the open front and top portions of the insert, retainers positioned proximate the rear portion of the insert structure. A forwardly extending portion of the floor portion extends forwardly from the side walls, and includes angled side portions which abut the edges of the mailbox door for directing the insert structure outwardly through the mailbox door.

13 Claims, 2 Drawing Sheets

Fig. 1
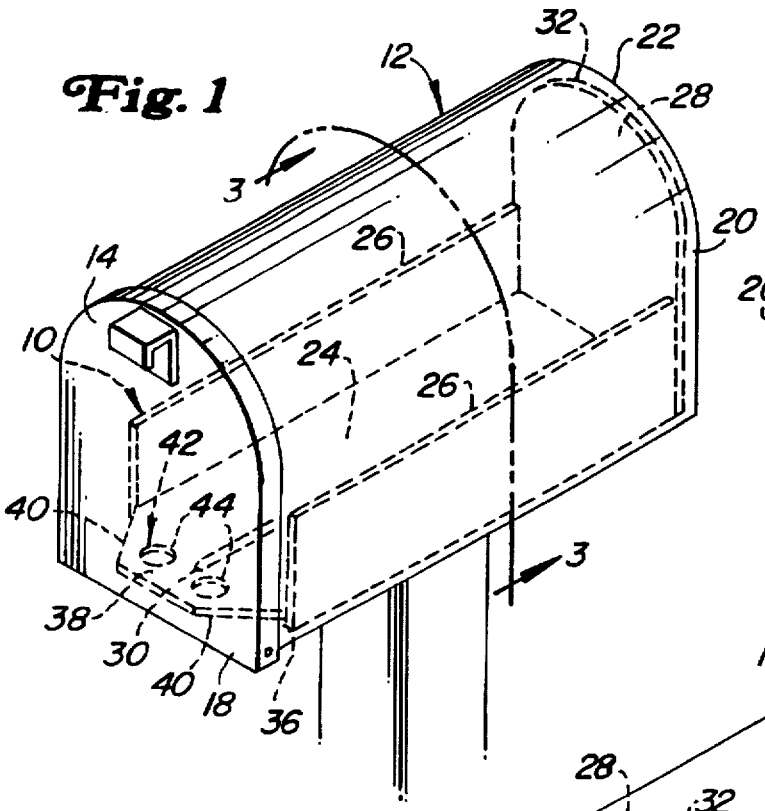
Fig. 3
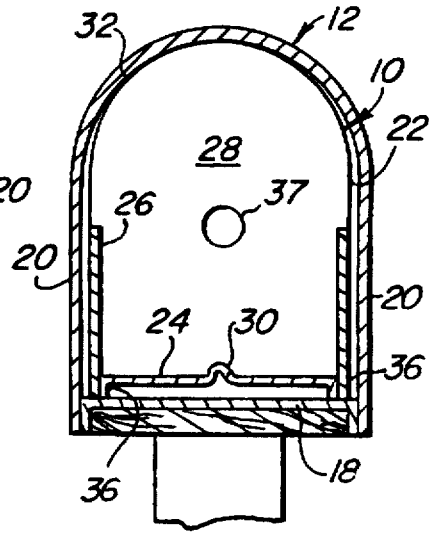
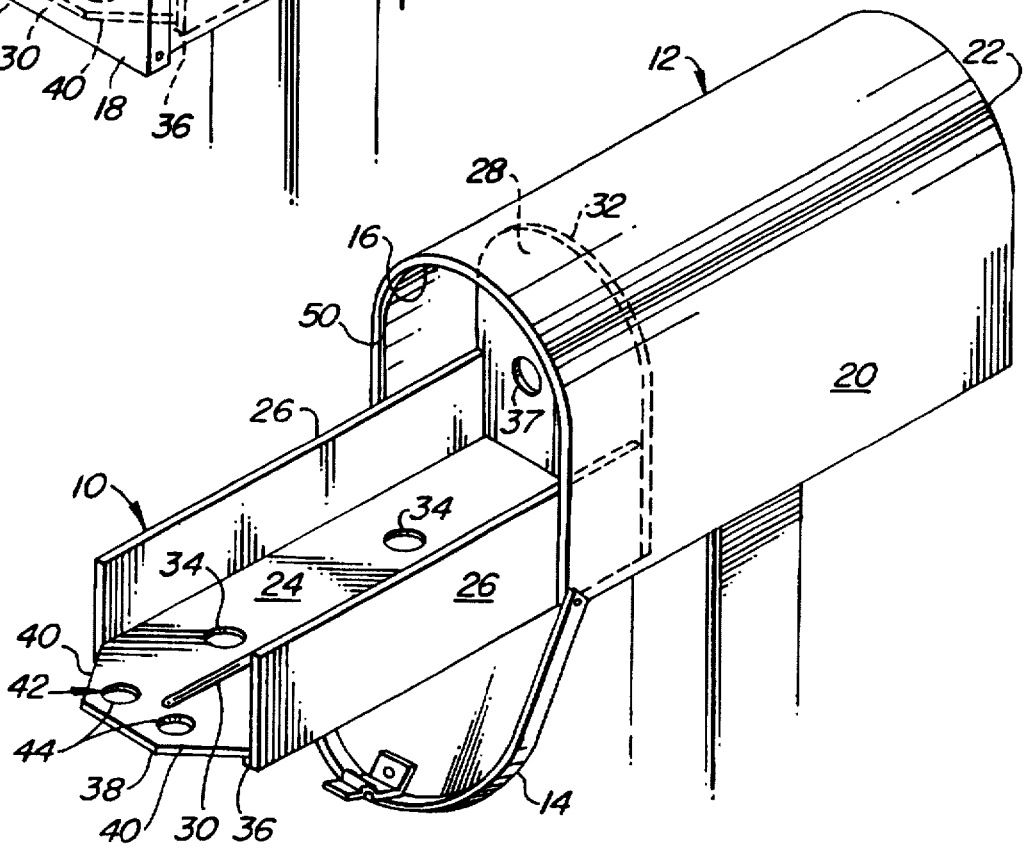
Fig. 2

MAILBOX INSERT DEVICE

BACKGROUND OF THE INVENTION

1) Field of the Invention

This invention is a mechanisms for assisting a person in removing mail from a mailbox.

Conventional roadside mailboxes tend to be relatively deep for receiving a large quantity of letters and other mail such as packages. The mailboxes shelter their contents from the elements. Some mailboxes are so large that people find it difficult to reach the mail positioned at the back portion of the mailboxes. To remove mail from the rear of the mailbox a person must bend over and awkwardly insert their arm into the mailbox to reach the packages at the back of the mailbox. Removing mail from the rear of a roadside mailbox can also be particularly difficult when the operator remains seated in a vehicle. The person seated in the vehicle typically must hang out the window of the vehicle in an awkward manner in order to reach the mail at the back of the mailbox. Large packages positioned in the rear of the mailbox can also be difficult to grasp since they may be only slightly smaller than the inside of the mailbox.

It would therefore be desirable to provide a mechanism which allows an operator to easily remove packages and other mail from the rear of large mailboxes. It would also be desirable for such a mechanism to allow an operator to more easily remove mail from a large roadside mailbox while seated in a vehicle.

One such mailbox insert is shown in U.S. Pat. No. 4,714,192 issued Dec. 22, 1987. This insert has flexible rear and front portions and does not provide support legs to reduce friction between box and insert.

2) Related Art

There have been previous sideable tray inserts for mailboxes. One such mailbox is shown in U.S. Pat. No. 4,714, 192 issued Dec. 22, 1987. This insert has flexible rear and front portions and does not provide support legs to reduce friction between the mailbox and the insert.

This insert was molded from plastic exhibiting materially flexible characteristics. Each side wall included a flexible finger for locating the insert tray and limiting the sliding movement of such tray. The tray also included a rearwardly inclined resilient member to move the tray when the mailbox opened. This rearwardly resilient member also was utilized to limit the pivotal motion of the tray as it was pulled from the mailbox. The bottom of the tray fitted directly onto the bottom of the mailbox. Other relevant patents are cited in the above reference.

BRIEF SUMMARY OF THE INVENTION

The preferred embodiment of the present invention provides a mailbox insert mechanism positionable within a mailbox for aiding in the removal of mail from the mailbox. The insert mechanism includes a floor portion, a back wall portion, and a pair of opposite side wall portions. The walls and floor of the insert form generally open front and top portions. An engagement portion positioned near the front of the floor portion of the insert structure is engagable by the fingers of an operator for pulling the insert structure outwardly through the mailbox door opening so that the operator can remove mail from the insert structure through the open front and top portions of the insert. The rear portion of the insert structure will abut the top portion of the mailbox proximate the door opening for blocking the insert structure from shifting completely out of the mailbox door opening.

The floor portion of the insert structure includes a forwardly extending portion which extends forwardly from the side walls, and includes angled side portions which abut the edges of the mailbox door for directing the insert structure outwardly through the mailbox door. The back wall is the same size and shape as the inside of the mailbox, and thereby helps supports the insert member in a level manner as the insert is pulled from the mailbox. Mail support members or ribs extend upwardly from the floor portion of the insert structure for supporting mail a distance above the floor portion of the insert structure. The ribs support the mail above the floor of the insert member and thereby keep the mail from contacting any small amounts of moisture or rain which may find its way into the mailbox. This moisture can migrate to the box floor through holes provided in the insert floor. One embodiment of the engagement portion provides an upraised portion which extends upwardly from the front of the floor portion and which is adapted to be engaged by the fingers of an operator for pulling the insert structure outwardly through the mailbox door. A sloped front portion of the upraised portion slopes upwardly and rearwardly for allowing mail to slide over the upraised portion as the mail is inserted into the mailbox.

A second embodiment of the engagement portion provides at least one opening formed in the floor portion and is adapted to receive at least one finger of an operator as the operator pulls the insert structure outwardly through the mailbox door. The insert member is supported above the floor of the mailbox by a plurality of leg members.

The leg members serve to limit the friction between the insert and the floor of the mailbox and therefore allow the insert to be pulled from the mailbox by only a relatively small force. The leg members also provide space above any moisture which collects on the mailbox floor. The insert member according to the present invention therefore allows an operator to easily access the mail at the back portion of a mailbox. The present invention also facilitates removal of mail from deep mailboxes while the operator is seated in a vehicle. The operator can open the mailbox door, pull the insert member toward the vehicle and easily remove the mail through the open front and top portions of the insert member without requiring the operator to awkwardly hang out the vehicle window to reach the mail at the back of the mailbox.

DESCRIPTION OF THE DRAWINGS

FIG. 1 is a perspective view of a mailbox insert mechanism according to the present invention positioned within a mailbox. The insert includes openings an operator can engage with his fingers for pulling or sliding the insert out through the mailbox door.

FIG. 2 is a perspective view of the insert mechanism of FIG. 1, showing the insert mechanism after it has been pulled from the mailbox to access the mailboxes contents.

FIG. 3 is a sectional view taken along line 3—3 in FIG. 1.

DETAILED DESCRIPTION OF THE INVENTION

Figure 4:
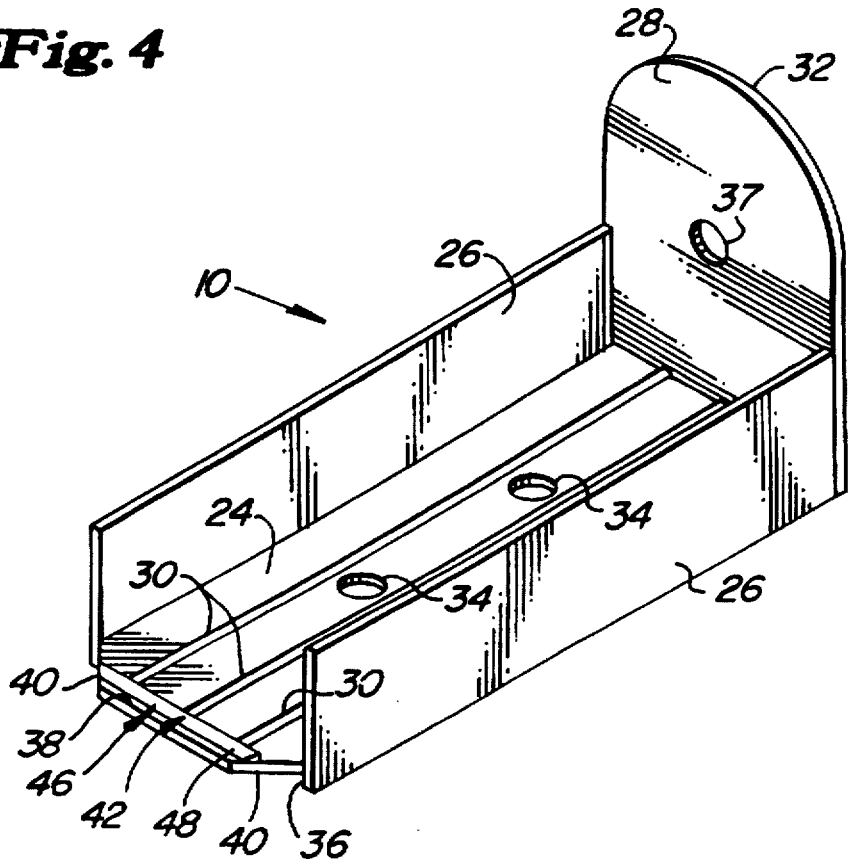
FIG. 4 is a perspective view of the a mailbox insert mechanism according to the present invention. The insert includes an upraised portion engagable by the hand of an operator for pulling the insert from the mailbox for accessing the contents of the mailbox.

Referring now to FIGS. 1–4, there is shown the mailbox insert structure 10 according to the present invention. The insert structure 10 is adapted to be placed inside a mailbox 12 having a door 14, door opening 16 at a front portion 50, a floor 18, sidewalls 20 and a rear wall 22. The insert 10 is adapted to receive mail that is placed inside the mailbox 12 by a mailman. The insert 10 can be slid outwardly through the door 14 of the mailbox 12 to pull the mail out of the mailbox 12 and help the operator access the mail at the rear of the mailbox 12.

The insert structure 10 includes a floor portion 24, side wall portions 26 and a rear wall portion 28. The floor portion 24 defines upstanding ribs or mail support members 30 which generally support mail a small distance above the surface of the floor portion 24. The ribs 30 will act to support mail above any small amounts of rain or moisture which may accumulate on the floor 24 of the insert structure 10. The holes 34 will drain the moisture from the insert to the mailbox. The rear wall portion 28 is shaped to mate with the shape of the inside upper portion of the mailbox 12, and includes a generally curved upper portion 32. The lower portions of the side walls 26 may define leg members 36 which extend downwardly from the floor portion 24 for engaging the floor 18 of the mailbox to 12 support the insert structure 10.

The front 38 of the floor portion 24 extends forwardly from the side walls 26. The side edges 40 of the forwardly extending portion 38 are angled at approximately forty-five degrees. The forwardly extending portion 38 also includes an engagement member 42. The engagement member 42 shown in FIGS. 1–3 includes a pair of openings 44 into which the operator can insert his fingers to pull the insert structure 10 out of the mailbox 12. The engagement member 42 shown in FIG. 4 is an upraised portion 46 which extends upwardly from the forwardly extending portion 38 of the floor 24. An operator places his fingers against the upraised portion 46 for pulling the insert structure 10 outwardly through the door 14 of the mailbox 12. The upraised portion 46 includes a sloped front surface 48 which slopes upwardly from front to back to allow mail to easily slide up and over the upraised portion 46 when the mail is being inserted into the mailbox 12 by a mailman.

Next, the operation of the present invention will be described in greater detail. First, the insert structure 10 is placed within the mailbox 12 by sliding it rearwardly through the door 14 of the mailbox 12. It may be necessary to cant the insert slightly, due to close fit of rearwall 28 to the mailbox, to permit the rearwall 28 to pass the projecting edge of the top of the mailbox. The leg portions 36 abut the floor 18 of the mailbox 12 and reduce the friction between the insert 10 and the mailbox floor 18 for allowing the insert 10 to easily slide into the mailbox 12. Once positioned inside the mailbox 12 the insert 10 is ready to receive mail. The mailman will open the door 14 and place mail within the mailbox 12 on the floor 24 of the insert structure 10. The mail may engage the sloped surface 48 of the engagement member 42 shown in FIG. 4, which will shift the mail upwardly over the engagement member 42 so the mail is not blocked from being inserted into the mailbox 12. The mailman will then return insert structure 10 inside mailbox 12, a hole or holes 37 may be cut in rearwall 28 to allow air to escape, permitting easier return of insert structure 10. The mailman will then close the mailbox door 14. The recipient of the mail can then remove the mail by opening the door 14 and pulling the insert structure 10 outwardly. The person will engage the engagement member 42 with their fingers and pull the insert structure 10 outwardly. As the insert member 10 begins sliding outwardly, the forwardly extending portion 38 will pass through the door 14 first. The angled side portions 40 of the forwardly extending portion 38 allow the insert 10 to easily pass through the door opening 16 and generally prevent the corners of the insert member 10 from abutting any inwardly extending edges of the door 14. The angled portions 40 thereby direct the insert member 10 straight through the door opening 16 and generally hinder the insert 10 from getting hung up on side edges near the door opening 16. As the insert 10 is pulled outwardly the leg portions 36 slide across the surface of the mailbox floor 18, and help reduce friction between the insert 10 and mailbox floor 18 so that only a small amount of force is required to pull the insert 10. The operator can pull the insert member 10 outwardly to the position shown in FIGS. 2 and 4 to generally expose the contents of the mailbox 12. In this position the insert 10 is held in a horizontal position by the rear wall 28's relatively tight fit with the inside shape of the mailbox 12 and from removal by the engagement with the inwardly projecting edges of the mailbox 12. Once pulled to the position shown in FIGS. 2 and 4, the operator can easily remove the contents of the mailbox 12 by lifting the packages and letters through the generally open top and front portions of the insert member 10. The insert structure 10 thereby helps an operator pull the contents out of the mailbox 12 and to a position at which the operator can easily grasp the mail without requiring the operator to awkwardly reach far inside the mailbox 12 to grasp mail at the rear of the mailbox 12. Once the mail has been removed from the insert structure 10, the operator can push the insert member 10 back into the mailbox 12 and close the door 14.

The insert mechanism 10 according to the present invention is well suited for helping an operator remove the contents from the mailbox 12 while seated in a vehicle. The operator can drive his vehicle up to a position adjacent to the mailbox 12. The operator can then open the mailbox door 14 by reaching through the window of the vehicle, and can slide the insert structure 10 toward the vehicle. The mail is thereby pulled closer to the operator seated in the vehicle, which makes it easier for the operator to reach the mail. Since the insert structure 10 pulls the mail closer to the vehicle, the need for the operator to hang out the vehicle's window to reach the mail in the back of the mailbox 12 is eliminated.

Two types of engagement members 42 are shown in the drawings. One type is shown in FIGS. 1–3 and provides openings 44 formed in the front of the insert's floor portion 24. The operator can place his fingers in the openings 44 and pull the insert 10 outwardly to expose the contents of the mailbox 12. The second and preferred type of engagement member 42 is shown in FIG. 4 and includes an upraised member 46 mounted to the front of the insert's floor 24. The operator can engage his fingers against the back edge of the upraised member 46 and pull forwardly on the insert structure 10 to expose the contents of the mailbox 12. Other shapes and designs could also be utilized for providing a structure against which the operator may place his fingers to pull the insert 10 out of the mailbox 12.

Having described the preferred embodiment, other features of the present invention will undoubtedly occur to those versed in the art, as will numerous modifications and alternations in the embodiments of the invention illustrated, all of which may be achieved without departing from the spirit and scope of the invention as defined in the appended claims.

What is claimed is:

1. A mechanism in combination with a mailbox having a floor, and side, top and back walls, and a door opening, said mechanism comprising:

a) a rigid insert structure positionable within the mailbox for helping remove mail from within the mailbox, said insert structure further comprising a floor portion, including support legs, a rigid back wall portion conforming to the top, a portion of said side walls, and a pair of opposite side wall portions, said insert structure having a generally open front and top portions, and an engagement portion positioned near the front portion of the insert structure floor portion which is engagable by an operator for pulling the insert structure outwardly through the mailbox door opening for allowing the mail to be removed from the insert structure through the open front and top portions of the insert structure.

2. The invention of claim 1, and further comprising:

a) mail support members extending upwardly from the floor portion of the insert structure for supporting the mail a distance above the floor portion of the insert structure.

3. The invention of claim 1, wherein said floor portion of the insert structure includes a forwardly extending portion which extends forwardly from the side walls, said forwardly extending portion includes angled side portions abutted with side edges of the mailbox door opening for directing the insert structure outwardly through the mailbox door opening.

4. The invention of claim 1, wherein said engagement portion further comprises an upraised portion which extends upwardly from the front portion of the floor portion of the insert structure and which is adapted to be engaged by the operator for pulling the insert structure outwardly through the mailbox door opening.

5. The invention of claim 4, wherein said upraised portion further comprises a sloped front portion which slopes upwardly and rearwardly for allowing mail to slide over the upraised portion as the mail is inserted into the mailbox.

6. The invention of claim 1, wherein said engagement portion further comprises at least one opening formed in the front portion of the floor portion of the insert structure and which is adapted to receive at least one finger of an operator for allowing the operator to pull the insert structure outwardly through the mailbox door opening.

7. The invention of claim 1, wherein said support leg members abut the mailbox floor for supporting the insert structure.

8. A mechanism in combination with a mailbox, said mailbox having a floor, and side, top and back walls, and a door opening, said mechanism comprising:

a) an insert structure positionable within the mailbox for aiding in the removal of mail from the mailbox, said insert structure further comprising;

1) a floor portion, 2) a rigid back wall portion conforming to the back wall of the mailbox, 3) a pair of opposite side wall portions, 4) a generally open front and top portions, 5) leg members supporting said floor portion above the floor of the mailbox, 6) an engagement portion positioned near the front of the floor portion of the insert structure which is engagable by an operator for pulling the insert structure outwardly through the mailbox door opening so that the operator can remove mail from the insert structure through the open front portion and top portion of the insert, 7) said rigid back wall abutting a portion of the mailbox proximate the door opening for blocking the insert structure from shifting completely out of the mailbox door opening, and 8) said floor portion of the insert structure includes a forwardly extending portion which extends forwardly from the side walls, said forwardly extending portion includes angled side portions which abut the mailbox door opening for directing the insert structure outwardly through the mailbox door.

9. The invention of claim 8, and further comprising mail support members extending upwardly from the floor portion of the insert structure for supporting mail a distance above the floor portion of the insert structure.

10. The invention of claim 9, wherein said engagement portion further comprises an upraised portion which extends upwardly from the front portion of the floor portion and which is adapted to be engaged by the operator for pulling the insert structure outwardly through the mailbox door opening.

11. The invention of claim 10, wherein said upraised portion further comprises a sloped front portion which slopes upwardly and rearwardly for allowing the mail to slide over the upraised portion as the mail is inserted into the mailbox.

12. The invention of claim 9, wherein said engagement portion further comprises at least one opening formed in a front portion of the floor portion and which is adapted to receive at least one finger of an operator as the operator pulls the insert structure outwardly through the mailbox door opening.

13. The invention of claim 9, wherein said leg members, which abut the mailbox floor for supporting the insert structure, are narrow strips.

* * * * *